United States Patent [19]

von der Eltz et al.

[11] 4,077,764

[45] Mar. 7, 1978

[54] PROCESS FOR THE CONTINUOUS DYEING OF TEXTILE POLYAMIDE FIBER MATERIAL WITH METAL COMPLEX DYES

[75] Inventors: Hans-Ulrich von der Eltz, Frakfurt am Main; Gerhard Pfeiffer, Bad Soden, Taunus, both of Germany

[73] Assignee: Hoechst Aktiengesellschaft, Frankfurt am Main, Germany

[21] Appl. No.: 690,057

[22] Filed: May 25, 1976

[30] Foreign Application Priority Data

May 28, 1975 Germany ..... 2523658

[51] Int. Cl.[2] ..... D06P 5/00; D06P 7/00

[52] U.S. Cl. ..... 8/18 A; 8/18 R; 8/42 B; 8/85 R; 8/88; 8/92; 8/168 B; 8/178 R

[58] Field of Search ..... 8/18 R, 18 A, 168 B, 8/42 B, 85 R, 88, 92

[56] References Cited

U.S. PATENT DOCUMENTS

| | | | |
|---|---|---|---|
| 3,232,691 | 1/1966 | Wilhelm et al. | 8/18 A |
| 3,374,107 | 3/1968 | Cotton | 8/18 |
| 3,458,271 | 7/1969 | Ito et al. | 8/18 |

FOREIGN PATENT DOCUMENTS

| | | |
|---|---|---|
| 872,526 | 7/1961 | United Kingdom. |
| 1,337,702 | 11/1973 | United Kingdom. |

*Primary Examiner*—A. Lionel Clingman
*Attorney, Agent, or Firm*—Curtis, Morris & Safford

[57] ABSTRACT

Process for the continuous dyeing of a textile material web made of polyamide fibers using an 1:2 metal complex dyestuff, by padding the dyestuff together with a thermally crosslinkable bindersystem on the basis of a combination of acrylic acid derivatives with a highly etherified precondensation product of melamine and formaldehyde, a crosslinkable protective colloid in the presence of a catalyst or an acid-yielding agent that give an acid effect only under heat, from an aqueous liquor under weakly alkaline conditions, and fixing it on the material by means of dry heat.

3 Claims, No Drawings

PROCESS FOR THE CONTINUOUS DYEING OF TEXTILE POLYAMIDE FIBER MATERIAL WITH METAL COMPLEX DYES

The present invention relates to a process for the continuous dyeing of textile material webs made of polyamide fibers using 1:2 metal complex dyestuffs.

Continuous dyeing of polyamide fiber material using metal complex dyes according to the padding process is known to be carried out by several methods. According to those methods, dissolved 1:2 metal complex dyes together with padding auxiliaries (ethyl diglycol, polyglycols) are padded in high concentrations and together with acids or acid-yielding agents on the textile material, dried and fixed thereon by allowing the material to dwell, by steaming or exposing it to dry heat. When dry heat is chosen for the fixing process, high temperatures that are close to the softening point of the polyamide fiber are required; in the case of polyamide 6 the temperatures go up to 195° C; with polyamide 6,6 they go up to 215° C, while the exposure time is 90 seconds. The real problem of those padding methods, however, is the limited solubility (and thus the stability of the bath) of the usual metal complex dyes (that are not specifically finished). This applies in particular to the solubility of these dyes in an acid medium in the presence of acids, acid salts and acid-yielding agents, which require a high concentration of solubility-promoting padding auxiliaries.

We have now found that 1:2 metal complex dyestuffs can be fixed on polyamide textile webs according to the pad - dry heat fixing process to give fast shades by padding these dyes, together with thermally cross-linkable binder systems from aqueous liquors at room temperature and under weakly alkaline conditions onto the material, then drying the material and fixing the dyestuff over 3 to 6 minutes, preferably over 5 minutes, at 130° to 170° C, preferably at 140° to 160° C, by means of dry heat.

The thermally cross-linkable binder system consists of an aqueous dispersion combined from acrylic acid derivatives, such as acrylic acid esters, methylol acrylamides or acrylonitriles or mixtures thereof, with highly etherified precondensation products of melamine and formaldehyde, an also cross-linkable protective colloid,preferably on the basis of polyacrylamide, and a catalyst or acid-yielding agent which only give an acid effect under heat, preferably of the alkylolamine hydrochloride type, especially the aminopropanol hydrochloride, which is still weakly alkaline in the solution and does not precipitate the anionic dyestuff.

The aforesaid components are added to the dyestuff solution in the following amounts and order of sequence:

80 – 120 g/l of acrylic acid derivative,
45 – 55 g/l of precondensation product of melamine and formaldehyde,
15 – 25 g/l of acid catalyst/acid-yielding agent, and
55 – 65 g/l of protective colloid;

these padding liquors are stable at room temperature and at a pH of from 7.2 to 7.8 for a prolonged period of time. When the proportions given in the Examples are substantially higher or lower than indicated, the bath stability and thus the color yield may be impaired.

The textile material that has been padded is then dried and thermally treated in the conventional apparatus using dry heat. The necessary temperatures of about 150° C can be reached both on thermosoling devices and on installations which are used, e.g. for the condensation of synthetic resins in high-quality finishing. The temperature range of the invention (about 150° C) is, however, substantially lower than that of conventional thermosoling methods (of about 200° C); so this process can also be performed on installations which are not intended for the termosoling process as such.

The 1:2 metal complex dyes which do not contain carboxylic and/or sulfonic acid groupings and which may be used according to the invention are disclosed under the term "Acid Dyes" in Colour Index, 3rd edition, 1971, Vol. 1.

The typical advantages of the process of the invention over the prior art methods are the following ones: Even with a concentration of dyestuff close to the limit of solubility, the padding liquors show a good bath stability that lasts for a prolonged period of time. Owing to the special acid-yielding agent which displays its effect only under heat, the liquors are very weakly alkaline, and the combined binder system apparently has a favorably stabilizing influence on the dyestuff solution. This results in an optimum color yield; the whole amount of dyestuff applied is fixed both on the fiber and on the polymer coating, thus also improving the fastness properties, especially the fastness to rubbing in wet medium. Solubilizing padding auxiliaries need not be used; those auxiliaries are soluble in water and get into the waste water during the rinsing operation, thus bringing along considerable pollution. In contradistinction thereto, the binder systems which are combined according to the invention are almost quantitatively cross-linked and therefore insoluble in water.

Another surprising advantage over the conventional thermosoling methods is the substantially reduced fixation temperature of about 150° C, which also allows simpler fixation equipment to be used. The reason for such a low fixation temperature is the affinity of the dyestuff for the fiber and for the polymer coating.

The following Examples illustrate the invention.

EXAMPLE 1

A needled felt material made of polyamide 6 fibers was padded on a broad-size padding machine with a liquor pickup of about 90% (calculated on the weight of the dry material) and at room termperature with an aqueous liquor containing, per liter, 15 g of the 1:2 cobalt complex compound of the dyestuff of the formula

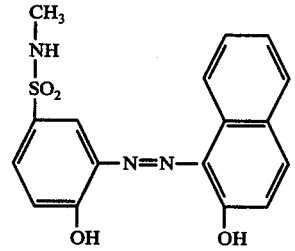

which had been made into a paste with cold water and dissolved in hot water, 100 g of a 40% aqueous monomer dispersion of 84% by weight of ethyl acrylate,
11% by weight of n-methylol acrylamide, and
5% by weight of acrylonitrile, 50 g of a thermally cross-linkable, highly etherified precondensation product of melamine and formaldehyde in the form of an aqueous dispersion, 20 g of aminopropanol hydrochloride, and 60 g of a 5% aqueous solution of polyacrylamide.

This padding liquor had a pH value of 7.6 and was stable for a prolonged period of time.

The textile material thus padded was then dried and exposed for 5 minutes to a temperature of 150° C to fix the dyestuff. The thermal treatment was performed in the same apparatus as used for the condensation of the back side coating of the material. At the same time, the back-reinforcing material (e.g. of thermoplastic fibers) could be applied.

The dyed material was then rinsed with warm water, dried and again needled to provide a bordo-red dyeing of full color yield and very good fastness to rubbing in wet medium.

EXAMPLE 2

This dyeing was produced as described in Example 1 using, however, a polyamide 6 fabric and 20 g of the 1:2 chromium complex compound of the dyestuff of the formula

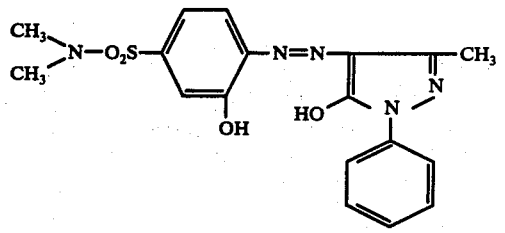

per liter of padding liquor. The liquor pick-up was 40% by weight. A full red dyeing was obtained which had a very good fastness to rubbing in wet medium and showed a certain degree of finish.

We claim:

1. In a process for the continuous dyeing of a textile material web made of polyamide fibers using a 1:2 metal complex dyestuff according to a pad-dry heat fixation method, the improvement which comprises: padding said textile material web under weakly alkaline conditions with an aqueous liquor containing a solution of said dye-stuff together with a thermally cross-linkable binder system comprised of 80 – 120 g/l of acrylic acid derivatives with 45 – 55 g/l of a highly etherified precondensation product of melamine and formaldehyde, and 55 – 65 g/l of a polyacrylamide and 15 – 25 g/l of a heat-effective catalyst of the alkylolamine hydrochloride type.

2. A process as claimed in claim 1, wherein the acrylic acid derivatives used are acrylic acid esters, methylol acrylamides or acrylonitriles or mixtures thereof.

3. A process as claimed in claim 1, wherein the catalyst used is aminopropanol hydrochloride.

* * * * *